United States Patent [19]

Tam

[11] 4,266,499

[45] May 12, 1981

[54] OFFSHORE COLUMN WITH MOORING HAWSER SYSTEM

[75] Inventor: William A. Tam, Greenville, Pa.

[73] Assignee: Chicago Bridge & Iron Company, Plainfield, Ill.

[21] Appl. No.: 70,095

[22] Filed: Aug. 27, 1979

[51] Int. Cl.[3] ..... B63B 21/00

[52] U.S. Cl. ..... 114/230; 9/8 R; 9/8 P; 405/202; 405/224

[58] Field of Search ..... 9/8 R, 8 P; 114/230, 114/144 B, 264, 293, 266, 267; 405/195, 196, 197, 199, 202, 205, 210, 224, 225; 254/173 R, 135 R

[56] References Cited

U.S. PATENT DOCUMENTS

| | | | |
|---|---|---|---|
| B 379,955 | 1/1975 | Verslius | 9/8 P |
| 3,695,207 | 10/1972 | Atlas | 114/230 |
| 3,950,806 | 4/1976 | Puchois | 114/230 |
| 3,980,037 | 9/1976 | Tuson | 9/8 P |
| 4,138,751 | 2/1979 | Kentosh | 114/230 |
| 4,155,670 | 5/1979 | Stafford | 405/202 |

*Primary Examiner*—Trygve M. Blix
*Assistant Examiner*—D. W. Keen
*Attorney, Agent, or Firm*—Merriam, Marshall & Bicknell

[57] ABSTRACT

In an apparatus for mooring a vessel offshore comprising an elongated buoyant column pivotally connected at the lower end to a base anchored to a sea floor, the improvement comprising a hawser-receiving tube in the column; a hawser guide located in the column top portion; a hawser having a first end located down in the tube and extending upwardly in the tube through the hawser guide and terminating outwardly from the column in a second end to be connected to a vessel; and a remotely operable connector at the first end of the hawser for releasably but stationarily securing the hawser end to the tube so that traction applied by a vessel moored on the hawser second end is fully resisted.

8 Claims, 2 Drawing Figures

OFFSHORE COLUMN WITH MOORING HAWSER SYSTEM

Figures 1, 2:
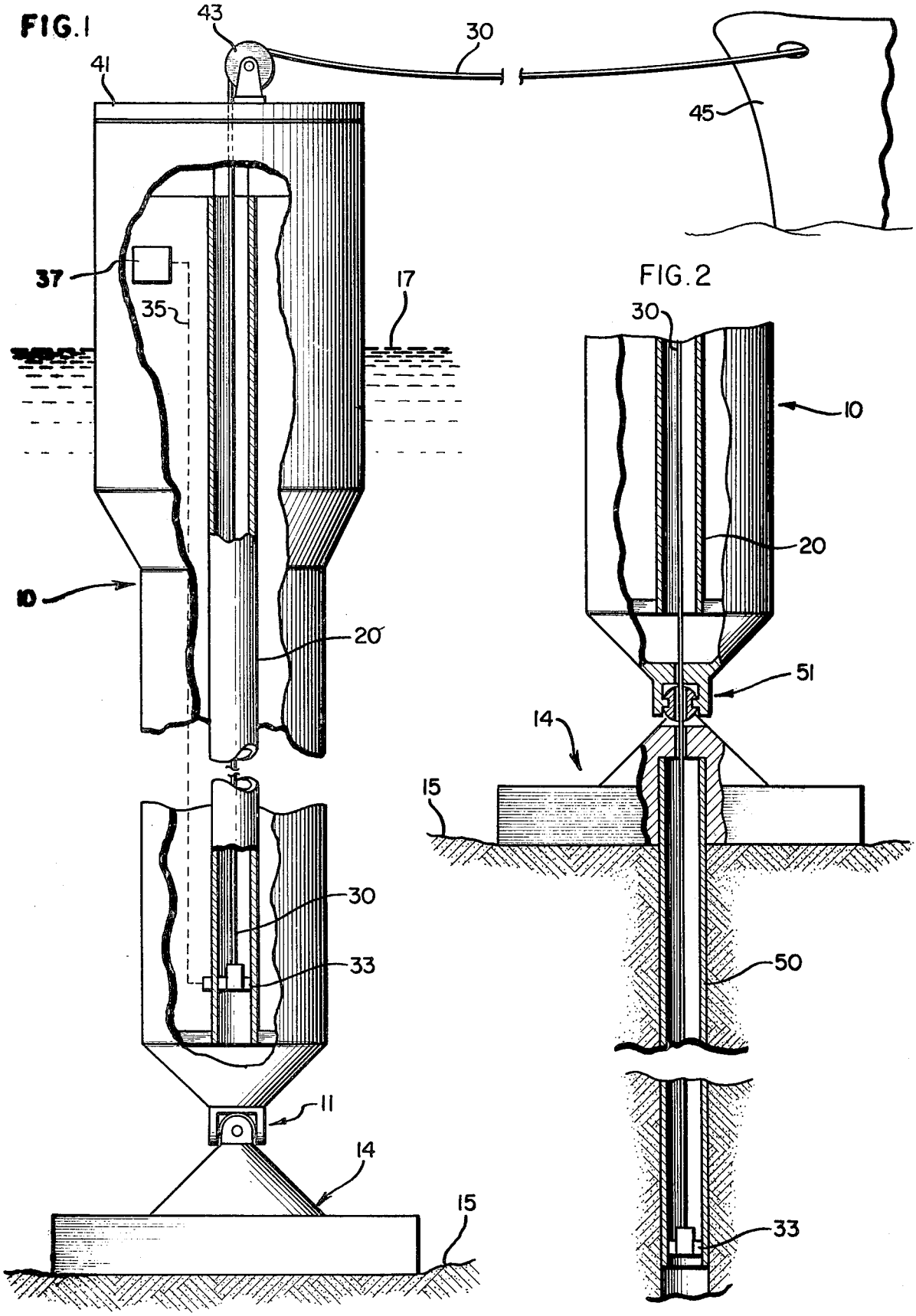

This invention relates to the offshore mooring of vessels or ships. More particularly, this invention is concerned with an improved mooring hawser arrangement on a sea floor-supported offshore tower or column.

Because of the large size of many vessels or ships, they cannot be moored or docked in many harbors. Loading and unloading of such vessels is, accordingly, effected when they are moored offshore in deep water. Furthermore, many vessels, small enough to enter harbors, are moored offshore to take on oil from offshore producing wells.

It is not practical, in many instances, to anchor ships offshore because of the water depth and because anchoring often will not hold a vessel sufficiently securely during storm conditions. Vessels, therefore, have been moored by wire ropes or hawsers to various devices secured offshore, including buoys anchored to the seafloor, rigid stationary platforms supported by the sea floor, and articulated towers or columns supported by the sea floor and having one or more universal joints which permits the tower to oscillate with change in sea conditions.

Regardless of the mooring device involved, it is desirable to use a wire rope or hawser no longer than necessary. This is partially because the hawsers are expensive and difficult to handle because of their size and weight. In addition, when the moored vessel is to load or unload oil through a hose from the tower to the ship, it is desirable to moor the vessel fairly close to the mooring device so that the hose length can be minimized and because this reduces yawing of the vessel.

Mooring of a vessel to the top of an offshore mooring device using a wire rope or hawser extending to the ship is often unsuitable because high seas and storm conditions induce sudden, high stresses which cause hawser failure, largely because the shortness of the hawser provides insufficient yield to absorb the stresses.

It has been proposed in Tuson U.S. Pat No. 3,980,037 to extend a hawser downwardly into an articulated mooring column or tower and to place a counterweight on the hawser end in the column. When mooring of a vessel is completed, as a result of traction applied from the vessel, the hawser portion in the column is essentially fully extracted and the counterweight is raised to an upper stop and held there, and subsequent traction by the vessel is taken by the column. This hawser mooring system thus does not provide a means of increasing the effective mooring hawser length. The entire hawser extends from the column top to the vessel, without increasing the mooring distance from the column top to the vessel, since the entire hawser extends from the column top to the vessel when mooring is completed.

According to the present invention, there is provided an improvement in apparatus for mooring a vessel offshore comprising an elongated buoyant column and means for pivotally connecting the lower end of the column to a base anchored to a sea floor, with the improvement comprising a hawser receiving tube positioned in the column, a hawser guide means located in the column top portion, a hawser having a first end located down in the tube and extending upwardly in the tube through the hawser guide means and terminating outwardly from the column in a second end adapted to be connected to a vessel, and a remotely operable connector at the first end of the hawser for releasably but stationarily securing the hawser end to the tube so that traction applied by a vessel moored on the hawser second end is fully resisted.

The remotely operable connector used should be one which permits quick and easy replacement of the hawser. Such a connector, desirably, is one which is hydraulically operated.

The hawser can be made entirely of metal or nonmetallic material. Thus, the hawser can be a wire rope or a rope made of a polymeric material such as nylon. In addition, lengths of different types of hawsers can be joined together. However, it is preferred to use a hawser made of nylon for its entire length.

In a further aspect of the invention, the end of the hawser is releasably secured by a remotely controlled connector in a casing in the sea bed extending downwardly from the column base.

The invention will be described further in conjunction with the attached drawings, in which:

FIG. 1 is an elevational view, partially broken away and partially in section, of an offshore pivotally mounted buoyant column having a hawser system according to the invention; and FIG. 2 is an elevational view, partially broken away and partially in section, of the lower portion of a buoyant column in which the lower end of the hawser is releasably secured in a casing in the sea bed.

So far as it is practical, the same numbers will be used in the various views shown in the drawings to identify the same elements or parts.

With reference to FIG. 1, column 10 is of generally metal tubular construction with buoyancy chambers located in the upper portion thereof to maintain the column essentially upright. A universal joint, pivotal connection 11 of conventional construction is located at the lower end of column 10 and joins it to base 14 anchored to sea floor 15. Column 10 is located in deep water but its upper end extends above sea level 17. Unless it is to be used to store oil, the column interior space may be in communication with the sea.

Hawser receiving tube 20 is positioned fixedly upright inside of column 10. Tube 20 ends near the bottom, and terminates near the top, of column 10. The interior space of tube 20 can also be in communication with the sea.

A hawser 30, such as a nylon rope, is located inside of tube 20. The lower end of the hawser 30 is releasably but stationarily secured to the tube 20 by a remotely operable hydraulic connector 33. A suitable connector for this purpose is commercially available through Vetco Offshore, Inc. as the H-4 hydraulic connector. One or more hydraulic lines 35 extend from connector 33 to a remote control station 37 located in the upper portion of column 10. The connector 33 can be actuated from control station 37 to grip or release the lower end of hawser 33.

The top of column 10 is provided with a rotating deck 41 mounted on suitable bearings so that it can rotate in a complete circle. Hawser hanger sheave 43 is mounted on deck 41 to rotate with it. Hawser 30 extends over sheave 43 and when not in use it will hang down into, or it will be arranged to float on, the water. However, to moor a vessel, the outer end of hawser 30 is retrieved and secured to vessel 45 in some suitable manner.

The hawser arrangement shown in FIG. 1 permits the effective length of the hawser to be the distance from the vessel to the column plus the depth of the water. Since the distance from the moored vessel to the column top will generally be at least 100 feet, and the column length will be about 100 feet set on a foundation in a sea of about that depth, the effective hawser length can easily be a minimum of 200 feet at all times. This hawser effective length, furthermore, is achieved without increasing the distance between the vessel and column top.

Increasing the hawser effective length as described is advantageous because the spring constants of reasonable length hawsers are such that they cannot moor vessels in sea states higher than approximately 10 to 12 feet. The spring constant of a hawser is the ratio of the force or load applied on a hawser to the distance the hawser stretches with the load. Since the force or load is applied on the entire hawser length, the longer the hawser is, the lower the spring constant will be based on that length of hawser. Therefore, by increasing the available length of the hawser, the mooring load will be able to stretch the hawser a greater distance before reaching the ultimate tensile strength of the hawser. This permits loading a hawser-moored vessel in higher sea states than would otherwise be possible because the forces applied to the hawser can be accommodated by hawser stretching, rather than breaking.

When a large tanker or other vessel is moored to an articulated tower or column supported on a sea floor, sea conditions have a relatively small effect on the vessel because of its immense size. It remains relatively stationary while the column top rapidly oscillates as much as fifteen or more feet. This necessitates that the mooring hawser be able to accommodate this variable distance between the vessel and the tower or column without breaking. By lowering the spring constant, through the increased available length of the hawser, the invention permits such mooring.

In those cases where even an additional length of hawser is required to obtain the proper spring constant, the hawser length from the vessel to the column top can be increased, such as up to 200 feet.

The hawser can be made self-stowing in the tube 20 in the column when not used to moor a vessel or ship. By letting the weight of the hawser always in the tube retract that portion of the hawser which is extended out of or beyond the tube top when used to moor a vessel, hawser self-retrieval is readily effected. Of course, a suitable stop is placed at the hawser upper end to prevent the hawser from falling completely into the tube 20. Also, a messenger line can be attached to the hawser upper end so as to provide a ready means by which to pull the hawser out of the tube 20 to a mooring vessel. The described self-stowing feature of the invention eliminates a tendency of the hawser to tangle and protects it from accidental damage.

The effective length of the hawser also can be increased by extending the hawser length through the pivotal connection into a casing in the sea bed. As shown in FIG. 2, casing 50 is driven into the sea bed and then foundation 14 is positioned centrally over it. A pivotal connection 51, of the universal joint type, having a conduit or access hole through which a hawser can freely pass, joins the base 14 to the lower end of column 10. One type of pivotal connection which can be used for this purpose constitutes a ball and socket, such as disclosed in U.S. Pat. No. 4,155,670.

It should be understood that the releasable connector 33 used in the embodiment of FIG. 2 may be of the same type previously described with respect to FIG. 1.

It is not essential for the base, to which the lower end of the column is connected, to be in actual contact with the sea floor. The base, for example, can be located above and out of contact with the sea floor but below sea level. It can be anchored to the sea floor, however, by means of chains or wire ropes which are fastened to piles or the like in the sea floor. The base is thus anchored to the sea floor, even if out of contact with it, in the same sense that a ship is anchored when it drops its anchor to the sea floor.

The foregoing detailed description has been given for clearness of understanding only, and no unnecessary limitations should be understood therefrom, as modifications will be obvious to those skilled in the art.

What is claimed is:

1. In an apparatus for mooring a vessel offshore comprising an elongated buoyant column and means for pivotally connecting the lower end of the column to a base anchored to a sea floor, the improvement comprising:

a hawser-receiving tube in the column;

a hawser guide means located in the column top portion;

a hawser having a first end located down in the tube and extending upwardly in the tube through the hawser guide means and terminating outwardly from the column in a second end to be connected to a vessel; and a remotely operable connector at the first end of the hawser for releasably but stationarily securing the hawser end to the tube so that traction applied by a vessel moored on the hawser second end is fully resisted.

2. The improvement according to claim 1 in which the connector is hydraulically operated.

3. The improvement according to claim 1 in which most of the length of the hawser is made of non-metallic material.

4. The improvement according to claim 1 in which the hawser is self-stowing in the tube.

5. In an apparatus for mooring a vessel offshore comprising an elongated buoyant column and means for pivotally connecting the lower end of the column to a base anchored to a sea floor, the improvement comprising;

a hawser-receiving tube in the column;

a hawser guide means located in the column top portion;

a casing in the sea bed extending downwardly from the column base;

a conduit means through which a hawser can extend from the column tube to the casing;

a hawser having a first end located down in the casing and extending upwardly in the casing through the conduit means and tube, and through the hawser guide means and terminating outwardly from the column in a second end to be connected to a vessel; and a remotely operable connector at the first end of the hawser for releasably but stationarily securing the hawser end to the casing so that traction applied by a vessel moored on the hawser second end is fully resisted.

6. The improvement according to claim 5 in which the connector is hydraulically operated.

7. The improvement according to claim 5 in which most of the length of the hawser is made of non-metallic material.

8. The improvement according to claim 5 in which the hawser is self-stowing in the tube.

* * * * *